US006332398B1

(12) United States Patent
Reinhard et al.

(10) Patent No.: US 6,332,398 B1
(45) Date of Patent: Dec. 25, 2001

(54) METHODS AND DEVICES FOR TRANSPORTING A SHEET

(75) Inventors: Gerald Josef Reinhard, Sulzfeld; Johannes Georg Schaede, Würzburg, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/600,880

(22) PCT Filed: Feb. 10, 1999

(86) PCT No.: PCT/DE99/00349

§ 371 Date: Sep. 19, 2000

§ 102(e) Date: Sep. 19, 2000

(87) PCT Pub. No.: WO99/41082

PCT Pub. Date: Aug. 19, 1999

(30) Foreign Application Priority Data

Feb. 13, 1998 (DE) ..... 198 05 920

(51) Int. Cl.[7] ..... B41F 13/24

(52) U.S. Cl. ..... 101/234; 101/231; 271/225

(58) Field of Search ..... 101/76, 216, 229, 101/230, 231, 232, 233, 234, 183, 184; 271/184, 185, 186, 225

(56) References Cited

U.S. PATENT DOCUMENTS

| | | | | |
|---|---|---|---|---|
| 4,186,662 | | 2/1980 | Borneman . | |
| 4,204,472 | | 5/1980 | Borneman . | |
| 4,210,078 | | 7/1980 | Greiner et al. . | |
| 4,448,121 | * | 5/1984 | Uno et al. | 101/76 |
| 5,377,587 | * | 1/1995 | Kobler | 101/233 |
| 5,797,321 | * | 8/1998 | Shibata | 101/246 |

FOREIGN PATENT DOCUMENTS

| | | |
|---|---|---|
| 295596 | 4/1916 | (DE) . |
| 2401027 | 3/1979 | (FR) . |
| 469309 | 7/1937 | (GB) . |

OTHER PUBLICATIONS

Sheet Feed System,XP–000735770, 944/*Research Disclosure*, Dec. 1997.

* cited by examiner

*Primary Examiner*—Ren Yan
(74) *Attorney, Agent, or Firm*—Jones, Tullar & Cooper,PC

(57) ABSTRACT

A sheet processing device is provided in a sheet-fed printing press. Sheets are conveyed to a sheet transport cylinder and are processed on the sheet transport cylinder. The sheets are each removed twice from the sheet transport cylinder.

4 Claims, 1 Drawing Sheet

01

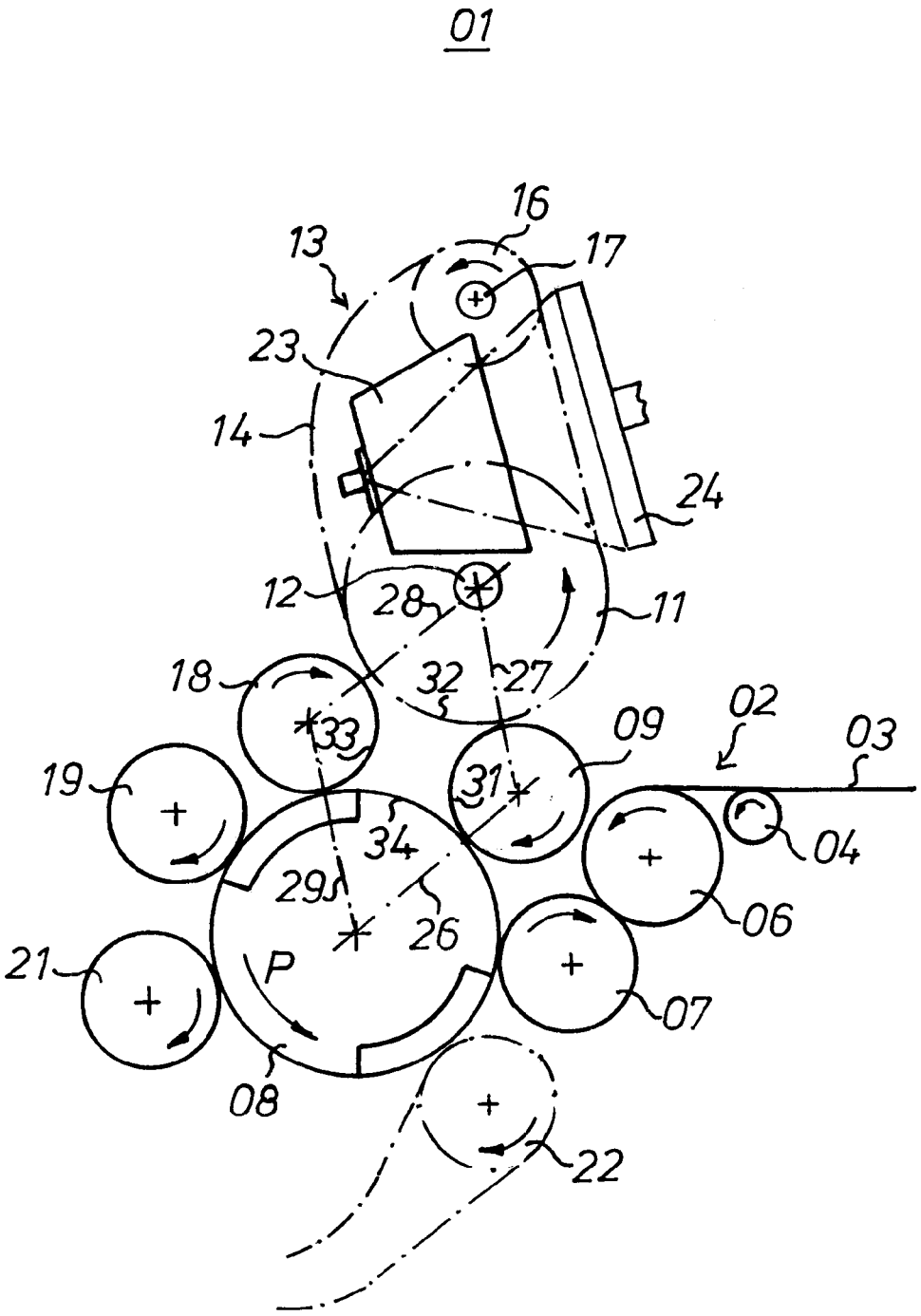
01
16
13
17
23
14
24
12
28
11
18
32
27
33
09
02
03
19
31
34
04
29
26
06
21
P
07
08
22

METHODS AND DEVICES FOR TRANSPORTING A SHEET

FIELD OF THE INVENTION

The present invention relates to methods and devices for transporting sheets. A sheet to be transported or conveyed in a sheet processing machine with at least one conveying cylinder is fed to the conveying cylinder in two successive passes.

DESCRIPTION OF THE PRIOR ART

The document "Sheet Feed System" Research Disclosure, December 1997, XP000735770, page 944, describes a method for conveying sheets in a sheet processing machine having a conveying cylinder and the following steps:

a sheet is fed to the conveying cylinder, this sheet is removed from the conveying cylinder by means of a pair of rollers and a belt conveyor system, a position of this sheet is checked, the sheet is thereafter conducted to the conveying cylinder a second time for perfecting.

FR-A-2 401 027 describes a device for conveying sheets in a sheet processing machine, having a conveying cylinder, to which a first sheet feeding device and a first sheet removal device, as well as a second sheet feeding device and a second sheet removal device are assigned.

DE 29 55 96 C1 shows two conveying drums assigned to a conveying cylinder, which are used as sheet feeding and removing device.

SUMMARY OF THE INVENTION

The present invention is based on the object of providing a method and devices for transporting sheets.

In accordance with the invention, this object is attain ed by using a sheet processing machine having at least one conveying cylinder. The sheet to be processed is fed to the conveying cylinder. This sheet is removes from the conveying cylinder and is then fed a second time to the conveying cylinder. The sheet may be conveyed by a chain or by a belt conveying system. The sheet is typically processed on the conveying cylinder.

With the method of the present invention and with the associated device, it is possible, in an advantageous manner, to retrofit existing presses with a device for executing a further processing step, in particular for performing an inspection.

If an inspection is performed prior to further processing steps, for example prior to numbering or printing, further processing can be controlled as a function of the inspection result, i.e. numbering can be omitted, for example.

In the present preferred exemplary embodiment, a first side of a sheet is checked and its second side numbered. In contrast to an inspection later, damage to the numbered side is avoided because of the inspection performed prior to numbering.

BRIEF DESCRIPTION OF THE DRAWINGS

A preferred embodiment of the present invention is represented in the drawings and will be described in greater detail in what follows.

The sole drawings show a schematic representation of a sheet processing machine in accordance with the present invention.

DESCRIPTION OF THE PREFERRED EMBODIMENT

A sheet processing machine 01, which may be, for example a sheet-fed rotary printing press, has, as seen in the sole drawing figure, an installation 02 placed downstream of a feeding device, not specifically represented. This installation 02 essentially consists of, for example, a feed table 03, a suction drum 04, a first conveying drum 06 and a second conveying drum 07.

A first processing cylinder 08, for example an impression cylinder 08, is situated downstream of the second conveying drum 07. Viewed in the direction P of production, a third conveying drum 09 is assigned to the impression cylinder 08 and is located downstream of the second conveying drum 07. This third conveying drum 09 acts in cooperation with chain wheels 11 carried on a first chain wheel shaft 12 of a first chain conveying system 13. This first chain conveying system 13 has two endlessly rotating chains 14 lying next to each other in the axial direction. Chain gripper systems, which are not specifically represented, are arranged on these chains 14 and extend in the axial direction. The chains 14 of the first chain conveying system 13 are reversed by means of chain wheels 16 carried on a second chain wheel shaft 17 and are conducted back to the chain wheels 11 of the first chain wheel shaft 12. A fourth conveying drum 18 is arranged between this first chain wheel shaft 12 and the impression cylinder 08.

Two additional processing cylinders 19, 21 are connected downstream, viewed in the direction P of production, of this fourth conveying drum 18. In the present preferred embodiment these second and third processing cylinders 19, 21, respectively are embodied as numbering cylinders 19, 21. But these second and third processing cylinders 19, 21 can also be transfer cylinders, varnishing rollers, perforating rollers or formed cylinders of a print unit.

Downstream of the second and third processing cylinders 19, 21, viewed in the direction P of production, a second chain conveying system 22, which may be a sheet removal device of a delivery device, which is not specifically represented, is assigned to the impression cylinder 08.

A processing device 23, for example an inspection device 23, is arranged in the path of the chains 14 between the two chain wheel shafts 12, 17 of the first chain conveying system 13. This inspection device 23 essentially consists of an illumination device and a photoelectric sensor, for example a CCD area camera.

A suction box 24, extending in both the axial direction and in the production direction, is arranged opposite this inspection device 23 and outside of the path of the chains 14.

One or several other processing stations or devices, for example ink jet printers, laser printers, perforating devices or other printing devices can also be arranged in place of the inspection device 23.

In the present preferred embodiment, each conveying drum 06, 07, 09, 18 has one gripper system, and the impression cylinder 08 has two gripper systems. Thus, in reference to the nominal diameters of the conveying drums 06, 07, 09, 18, the impression cylinder 08 is double-turning. The chain wheels 11 of the first chain wheel shaft 12 are also embodied to be double-turning.

The impression cylinder 08, the first chain wheel shaft 12 and the third, 09, and fourth conveying drum 18 interposed between the first chain wheel shaft 12 and the impression cylinder 08 are arranged in such a way that circumferential lengths 31, 32, 33, 34 of the cylinders, which are prescribed by the center lines 26, 27, 28, 29 of adjoining cylinders, are of the same length. This means that a circumferential length 31 of the third conveying drum 09 between the impression cylinder 08 and the chain wheel shaft 12 is defined by a center line 26, which is described by an axis of rotation of the impression cylinder 08 and an axis of rotation of the third conveying drum 09, and by a center line 27, which is described by an axis of rotation of the chain wheel shaft 12 and the axis of rotation of the third conveying drum 09.

A circumferential length 32 of the path of the chains 14 in the area of the first chain wheel shaft 12 between the third and fourth conveying drums 09, 18 is defined by a center line 27, which is described by an axis of rotation of the third conveying drum 09 and the axis of rotation of the chain wheel shaft 12, and by a center line 28, which is described by an axis of rotation of the fourth conveying drum 18 and the axis of rotation of the chain wheel shaft 12.

A circumferential length 33 of the fourth conveying drum 18 between the first chain wheel shaft 12 and the impression cylinder 08 is defined by a center line 29, which is described by the axis of rotation of the impression cylinder 08 and an axis of rotation of the fourth conveying drum 18, and by a center line 28, which is described by an axis of rotation of the chain wheel shaft 12 and the axis of rotation of the fourth conveying drum 18.

A circumferential length 34 of the impression cylinder 08, between the third, 09, and fourth transfer cylinder 18, is defined by the center line 29, which is described by the axis of rotation of the impression cylinder 08 and an axis of rotation of the fourth conveying drum 18, and by a center line 26, which is described by the axis of rotation of the impression cylinder 08 and the axis of rotation of the third conveying drum 09.

In a simplifying manner, each circumferential length 31, 32, 33, 34 was defined in the above mentioned description, as a length of the path from the gripper feed devices of the gripper systems of the cylinders 08, 09, 18, or respectively the gripper systems of the chains 14.

In place of the above-described first chain conveying system 13, preferred embodiments with other numbers of chain wheels or a different guidance of the paths are possible. For example, a different number of conveying cylinders can be interspersed between the impression cylinder 08 and the first chain conveying system 13.

It is also possible to employ further drums or cylinders, or belt systems, in place of the first chain conveying system 13.

The operation of the sheet processing machine in accordance with the present invention is as follows:

A sheet to be processed by the sheet processing machine 01 is fed, in a known manner, to the first conveying drum 06 via the feed table 03 by means of the suction drum 04.

The first conveying drum 06 transfers the sheet to the second conveying drum 07, and the second conveying drum 07, which may also be called a first sheet guide device, passes the sheet on to the impression cylinder 08. The impression cylinder 08 conveys the sheet to the third conveying drum 09, which acts as a sheet delivery device, and which conveys the sheet to the first chain conveying system 13 and transfers the sheet to it.

The first chain conveying system 13 conveys the sheet to the inspection device 23. The sheet is steadied during its inspection by the suction box 24. The inspection takes place while the first chain conveying system 13 is running.

The first chain conveying system 13 conveys the checked sheet on to the fourth conveying drum 18 which acts as a sheet feeding device, and which returns the sheet to the impression cylinder 08.

The impression cylinder or first processing cylinder 08 conveys the checked sheet to the second processing cylinder 19. Following processing there, the checked and processed sheet is conveyed, by means of the impression cylinder 08 to the third processing cylinder 21 and is printed there.

Processing of the checked sheet can selectively take place using both of the second and third processing cylinders 19, 21, or only by use of one of the two selectable processing cylinders 19, 21.

For example, the processing cylinders 19, 21 can each be actuated depending on the result of the inspection done by the inspection device 23.

It is common to all of the preferred embodiments, that initially a sheet is conveyed to a sheet processing and conveying cylinder 08, which conveys the sheet during both first and second processing operations. The sheet is conveyed away by this sheet processing and conveying cylinder 08 for conveying the sheet to a second, or respectively to a first processing operation.

Following this processing operation, the sheet is again conveyed to this sheet processing and conveying cylinder 08 and is moved on.

The removal of the sheet from the sheet processing and conveying cylinder 08 can take place preferably prior to or also following a processing operation.

While preferred embodiments of methods and devices for transporting a sheet in accordance with the present invention have been set forth fully and completely hereinabove, it will be apparent to one of skill in the art that various changes in, for example, the type of printing press used, the drives for the various cylinders, and the like could be made without departing from the true spirit and scope of the present invention which is accordingly to be limited only by the following claims.

What is claimed is:

1. A device for conveying sheets in a sheet processing machine comprising:

at least one processing and conveying cylinder;

a sheet guide device adapted to direct sheets to be processed to said at least one processing and conveying cylinder;

a sheet delivery device located after, in a direction of sheet travel, said sheet guide device and adapted to remove sheets from said at least one processing and conveying cylinder;

a chain conveying device associated with said at least one processing and conveying cylinder, said chain conveying device receiving sheets from said sheet delivery device;

a sheet inspection device adjacent said chain conveying device and useable to inspect sheets and to generate a signal resulting from inspection of the sheets;

a sheet feeding device located after, in a direction of sheet travel, said chain conveying system, said sheet feeding device being adapted to remove sheets from said chain conveying device and to return sheets to said at least one processing and conveying cylinder;

at least one processing cylinder adapted to process sheets returned to said at least one processing and conveying cylinder, said at least one processing cylinder being controlled by said signal from said sheet inspection device; and a sheet removal device located after, in a direction of sheet travel, said at least one processing cylinder and adapted to remove processed sheets from said at least one processing and conveying cylinder.

2. A device for conveying sheets in a sheet processing machine comprising:

at least one processing and conveying cylinder;

a sheet guide device and a sheet removal device cooperating with said at least one processing and conveying cylinder:

a sheet feeding device and a sheet delivery device cooperating with said at least one processing and conveying cylinder:

a processing cylinder cooperating with said at least one processing and cylinder;

a chain conveying device cooperating with said sheet feeding device and said sheet delivery device; and a sheet inspection device adjacent said chain conveying device, said sheet inspection device inspecting said sheets and generating a signal, said signal being useable to switch said processing cylinder on and off.

3. The device of claim 2 further including a numbering cylinder associated with said at least one processing and conveying cylinder.

4. The device of claim 2 further including a CCD area camera in said sheet inspection device.

* * * * *